United States Patent [19]

Lauke et al.

[11] Patent Number: 4,970,138

[45] Date of Patent: Nov. 13, 1990

[54] DAMPING SOLUTION FOR OFFSET PRINTING

[75] Inventors: Harald Lauke, Mannheim; Gregor Schuermann, Heidelberg, both of Fed. Rep. of Germany

[73] Assignee: BASF Aktiengesellschaft, Ludwigshafen, Fed. Rep. of Germany

[21] Appl. No.: 284,243

[22] Filed: Dec. 14, 1988

[30] Foreign Application Priority Data

Dec. 24, 1987 [DE] Fed. Rep. of Germany ..... 3744121

[51] Int. Cl.[5] ..... G03C 5/00

[52] U.S. Cl. ..... 430/331; 430/309; 430/325; 556/405

[58] Field of Search ..... 430/309, 325, 331; 556/405

[56] References Cited

U.S. PATENT DOCUMENTS

| | | | |
|---|---|---|---|
| 3,108,535 | 10/1963 | Uhlig | 101/149.2 |
| 3,546,179 | 12/1970 | Koller | 556/405 |
| 3,780,127 | 12/1973 | Young | 260/682 |
| 3,816,550 | 6/1974 | Young | 260/641 |
| 4,084,951 | 4/1978 | Gregory | 556/405 |
| 4,116,896 | 9/1978 | Garrett | 260/17 R |
| 4,374,036 | 2/1983 | Canale | 252/135 |
| 4,772,408 | 9/1988 | Mohr et al. | 556/405 |

FOREIGN PATENT DOCUMENTS

| | | | |
|---|---|---|---|
| 0592213 | 2/1960 | Canada | 556/405 |
| 0091601 | 10/1983 | European Pat. Off. . | |
| 0220662 | 5/1987 | European Pat. Off. . | |

*Primary Examiner*—Paul R. Michl
*Assistant Examiner*—Hoa Van Le
*Attorney, Agent, or Firm*—Keil & Weinkauf

[57] ABSTRACT

An aqueous damping solution for the offset printing process contains a hydrolysis product of a compound of the general formula $$(R^1O)_2-\overset{\overset{\displaystyle O}{\|}}{P}-CH_2-CH_2-Si(OR^2)_3 \qquad (I)$$

wherein $R^1$ and $R^2$ are identical or different and are each hydrogen, alkyl of 1 to 9 carbon atoms or aryl of 6 to 12 carbon atoms, or a condensate of this hydrolysis product.

14 Claims, No Drawings

DAMPING SOLUTION FOR OFFSET PRINTING

The present invention relates to an aqueous damping solution for preventing ink acceptance by non-image areas during the offset printing process and for substantially reducing problems due to foreign ions. Offset printing plates generally consist of a base bearing a radiation-sensitive reproduction layer, with the aid of which an image of an original is produced by a photomechanical method. After the production of the printing plate, the base carries the image areas which convey ink during subsequent printing and at the same time forms the water-conveying image background (non-image areas) in the image-free areas.

In a base which is supposed to be suitable for photosensitive material for the production of a printing plate, it is therefore necessary, on the one hand, that the printing image areas developed from the copying layer of the material adheres very firmly to the said base and, on the other hand, that it has a hydrophilic image background and retains its repellent action against oleophilic printing inks under the requirements of the printing process.

During the printing process, an aqueous damping solution is generally applied to the plate surface, in addition to the printing ink.

The object of the said solution is to keep moist all parts not covered by the hydrophobic picture, in order to ensure that these non-image areas repel hydrophobic printing ink during the printing process. In conventional systems, the damping solution is applied to the plate by means of one or more rollers. One or more inking rollers which are covered with an oil-base printing ink make contact with the entire surface of the plate but, owing to the oil-repellent properties of the non-image areas, ink only the hydrophobic image areas.

Alternatively, it is also possible for the damping solution and some or all of the oil-based printing ink to be applied simultaneously with a roller.

In the simplest case, water is used as the damping solution. In many cases, however, it does not meet the high requirements of offset printing and problems in the form of ink acceptance in non-image areas frequently occur.

Agents such as gum arabic, glycerol and the like have long been known for imparting hydrophilic properties, the said agents usually containing added phosphates, citrates or the corresponding acids, which act as a buffer and adjust a pH to a pH of 4.5 to 6, which is particularly advantageous for offset printing.

The natural product gum arabic varies in its quality and, when used as a component of damping solutions, leads to excessive emulsification of the printing ink, which results in non-uniform inking of the printing plates.

Substitutes for gum arabic are known from the literature. For example, DE-A-26 25 604 (corresponding to US-A-4 116 896) describes a damping solution which contains firstly polyvalent metal ions, secondly not less than about 97% by weight of a solvent, the latter consisting of one or more monohydric or polyhydric lower alkyl alcohols or glycol ether having a molecular weight of about 170 or less and not less than about 75% by volume of water, and thirdly from 0.001 to 0.5% by weight of a selected active polymer component.

The disadvantage of using polymers is that surface drying leads to sticking or soiling of the printing press. DE-B-1 121 632 (corresponding to US-A-3 108 535) proposes an aqueous damping and cleaning agent for the offset printing process, the said agent containing polyvinylphosphonic acid, vinylphosphonic acid or a mixture of the components with glycerol, with or without the addition of substances familiar for damping solutions, such as ammonium phosphate, citrates, carboxymethylcellulose, etc.

The disadvantage of such solutions is, on the one hand, their unpleasant odor and, on the other hand, the expensive preparation procedure. EP-A-0 091 601 describes a damping solution which, instead of isopropanol, which is also used, contains water-miscible or watersoluble polymers, cellulose ethers, polyacrylamides, polyvinyl alcohols and chemically modified rubber products being used in particular. US-A-4 186 250 describes mixtures of polyacrylamides with polycarboxylic acids or their alkali metal salts. Such solutions have the deficiencies already described for the polymers.

US-A-4 374 036 describes a damping solution which contains polyphosphates, water-soluble polyethylene glycols, carboxymethylcellulose, nonionic or anionic surfactants of the alkyl orthophosphate and alkyl polyphosphate type and a polysiloxane.

The insufficient stability of polyphosphates to hydrolysis is disadvantageous, so that the procedure in this case has to be carried out in the neutral range, although in practice a pH of about 5 has proven more advantageous.

Damping solutions for offset printing which contain aminomethylenephosphonic acid and/or its derivatives have also been proposed.

It is an object of the present invention to provide a damping solution for offset printing which prevents catching up during the printing process and problems due to entrained cations, as a corrosion-inhibiting action, can be used in pH ranges which are optimal for the printing process, is not complicated to prepare and is composed of economical materials.

We have found that this object is achieved by a damping solution which contains [2-(trihydroxysilyl)-ethyl]phosphonic acid or its derivatives, for example its salts or condensates.

The present invention relates to an aqueous damping solution for the offset printing process, wherein the solution contains a hydrolysis product of a compound of the general formula (I)

$$(R^1O)_2-\overset{\overset{\displaystyle O}{\|}}{P}-CH_2-CH_2-Si(OR^2)_3 \qquad (I)$$

where $R^1$ and $R^2$ are identical or different and are each hydrogen, alkyl of 1 to 9 carbon atoms or aryl of 6 to 12 carbon atoms, or a condensate of this hydrolysis product.

Preferred damping solutions are those which contain a compound of the general formula (I) where $R^1$ and $R^2$ are each hydrogen.

The compounds of the general formula (I) may furthermore be partially or completely in the form of these salts and may additionally contain a buffer system, a biocide, a corrosion inhibitor, glycol and/or an alcohol.

The damping solution may be in the form of a concentrate, and the latter may contain from 0.01 to 100 g/l of the compound of the general formula (I).

The pH of the damping solution is advantgeously from 3.0 to 7.0, preferably from 4.0 to 5.5.

By using the novel damping solution, the hydrophilic properties in the non-image areas of the printing plate are regenerated during the offset printing process, with the result that catching up is prevented up to the end of the printing process. A particular advantage of the novel damping solution is that problems due to hard water or entrained cations are prevented. Another important advantage of the novel damping solution is that the compound of the general formula (I), in particular [2-(trihydroxysilyl)-ethyl]phosphonic acid and its salts, are readily obtainable from economical raw materials and can be prepared in constant quality and can also be used in fairly high concentrations.

Silanes of the general formula (I), e.g. dimethyl [2-(trialkoxysilyl)-ethyl]-phosphonates or diethyl [2-(trialkoxysilyl)-ethyl]-phosphonates, such as dimethyl or diethyl [2-(trimethoxysilyl)-ethyl]-phosphonate, can be hydrolyzed in concentrated hydrochloric acid in a conventional manner, for example as described in U.S. Pat. Nos. 3,780,127 and 3,816,550. After excess hydrochloric acid has been removed, the resulting product can be diluted with water. Condensates may also be formed to a certain extent during the hydrolysis. Hydrolysis products, condensates and mixtures of hydrolysis products and condensates of the compounds of the general formula (I) can also be used according to the invention for the damping solution, provided that it is ensured that the hydrolysis products or their condensates are completely dissolved or homogeneously dispersed in aqueous or alcoholic/aqueous solution.

Suitable salts of the hydrolysis products are their alkali metal and alkaline earth metal salts, in particular their $Na^+$, $K^+$ and $NH_4^+$ salts.

The hydrolysis products and/or their condensates or their salts are present in the novel damping solution in general in amounts of from 0.01 to 10, preferably from 0.1 to 2, % by weight, based on the total amount of the damping solution.

The pH of the damping solution is advantageously brought to 3–7, preferably 4–5.5.

To obtain particular effects, it may also be advantageous to add further substances, for example a buffer system, a biocide, a wetting agent, an antifoam, a corrosion inhibitor, a thickener, an alcohol and/or a glycol to the damping solution in a known manner.

The novel damping solution can also be stored in the form of a concentrate which contains up to 100 g/l of hydrolysis product of a compound of the general formula (I), its condensate or salts, with or without the abovementioned additives.

The novel damping solution makes it possible to maintain the hydrophilic properties and hence the water-conveying properties of the non-image areas to the printing process, without the occurrence of tacky deposits and associated problems, as encountered, for example, when high molecular weight compounds are used.

The Examples which follow illustrate the invention.

In the Examples, parts and percentages are by weight, unless stated otherwise. Testing the effectiveness of the damping solution:

An electrolytically roughened and anodically oxidized aluminum plate is immersed in the damping solution to be tested and is then dried. The entire plate is then printed in a proof printing press using offset ink. After the colour has dried in slightly, the plate is placed repeatedly in the damping solution and the time taken for the printing ink to become detached from the plate is determined. The more rapidly this occurs, the better is the action of the damping agent.

EXAMPLE 1

An electrolytically roughened and anodically oxidized aluminum plate was immersed in an aqueous solution whose pH had been brought to 5.0 with $Na_3PO_4$ and which contained 0.5% of [2-(trihydroxysilyl)-ethyl]-phosphonic acid. To test the effectiveness, the procedure described above was then followed. In the damping solution, the ink became detached very rapidly from the plate.

COMPARATIVE EXAMPLE 1

An electrolytically roughened and anodically oxidized aluminum plate was used for printing with offset ink, without further treatment. After the ink had slightly dried in, the plate was placed in distilled water. The ink did not become detached even after several hours.

EXAMPLE 2

An electrolytically roughened and anodically oxidized aluminum plate was immersed in a solution which contained 0.5% of glycerol and 0.5% of [2-(trihydroxysilyl)-ethyl]-phosphonic acid. After the further processing described above, it was found that the ink became detached very rapidly. In a printing test on a commercial offset printing press, advantageous results were accordingly obtained, i.e. more rapid free-running of the plate when the printing press is started up, and substantially reduced waste.

COMPARATIVE EXAMPLE 2

The test described in Example 2 was repeated, except that in this case [2-(trihydroxysilyl)-ethyl]-phosphonic acid was not added to the solution. The ink became detached from the plate only after several hours.

We claim:

1. An aqueous damping solution for the offset printing process, wherein the solution contains a hydrolysis product of a compound of the formula (I)

$$(R^1O)_2-\overset{\overset{\displaystyle O}{\|}}{P}-CH_2-CH_2-Si(OR^2)_3 \qquad (I)$$

where $R^1$ and $R^2$ are identical or different and are each hydrogen, alkyl of 1 to 9 carbon atoms or aryl of 6 to 12 carbon atoms, or a condensate of this hydrolysis product.

2. A damping solution as defined in claim 1, which contains a compound of the formula (I), where $R^1$ and $R^2$ are each hydrogen.

3. A damping solution as defined in claim 1, wherein the compound of the formula (I) is partially or completely in the form of its salt.

4. A damping solution as defined in claim 2, wherein the compound of the formula (I) is partially or completely in the form of its salt.

5. A damping solution as defined in claim 1, which additionally contains a buffer system.

6. A damping solution as defined in claim 1, which additionally contains one or more substances from the group consisting of a biocide, a corrosion inhibitor, a glycol and an alcohol.

7. A damping solution as defined in claim 2, which additionally contains one or more substances from the group consisting of a biocide, a corrosion inhibitor, a glycol and an alcohol.

8. A damping solution as defined in claim 1, which is in the form of a concentrate.

9. A damping solution as defined in claim 8, wherein the concentrate contains from 0.01 to 100 gel of a compound of the formula (I) as defined in claim 2.

10. A damping solution as defined in claim 1, which has a pH of from 3.0 to 7.0.

11. A damping solution a defined in claim 2, which has a pH of from 3.0 to 7.0.

12. A damping solution as defined in claim 1, which has pH of from 4.0 to 5.5.

13. A damping solution as defined in claim 2, which has a pH of from 4.0 to 5.5.

14. A damping solution as defined in claim 1, wherein the compound of the formula I is present in an amount of from 0.01 to 10% by weight, based on the total amount of the solution.

* * * * *